United States Patent [19]

Hillman

[11] 4,139,249

[45] Feb. 13, 1979

[54] CHILD-PROOF LATCH

[76] Inventor: Ernest C. Hillman, 1277 S. Adams St., Glendale, Calif. 91205

[21] Appl. No.: 849,017

[22] Filed: Nov. 7, 1977

[51] Int. Cl.[2] ..... E05C 19/06

[52] U.S. Cl. ..... 312/333; 312/348; 292/87; 292/175

[58] Field of Search ..... 312/333, 348; 292/87, 292/128, 175

[56] References Cited

U.S. PATENT DOCUMENTS

| | | | |
|---|---|---|---|
| 537,746 | 4/1895 | Boyum | 292/128 |
| 2,676,866 | 4/1954 | Woodin | 312/333 |
| 3,003,800 | 10/1961 | Hammond | 292/128 |
| 3,084,008 | 4/1963 | Mallett | 312/333 |
| 3,120,971 | 2/1964 | Bengtsson | 292/87 |
| 3,335,453 | 8/1967 | Lovelace | 292/175 |
| 3,381,992 | 5/1968 | Friesen | 292/87 |
| 3,397,001 | 8/1968 | Friedman | 312/348 |
| 3,889,992 | 6/1975 | Shelton | 292/87 |
| 3,923,347 | 12/1975 | Dean | 312/348 |
| 4,068,872 | 1/1978 | Smith | 292/87 |

FOREIGN PATENT DOCUMENTS

| | | | |
|---|---|---|---|
| 149535 | 12/1952 | Australia | 292/175 |

*Primary Examiner*—Victor N. Sakran
*Attorney, Agent, or Firm*—Fulwider, Patton, Rieber, Lee & Utecht

[57] ABSTRACT

A child-proof cabinet latch having a base mounted on an inaccessible inwardly facing surface of a closure panel and a restraining member that is slidable in a guide channel defined by the base. The restraining member is movable between a first position in which an abutment surface is engageable with the cabinet frame to permit only limited opening movement of the panel and a second position in which the abutment surface is not engageable with the frame to permit unlimited opening movement. A spring biases the restraining member toward its first position, the spring force being such that it can be overcome by an adult but not a small child.

7 Claims, 4 Drawing Figures

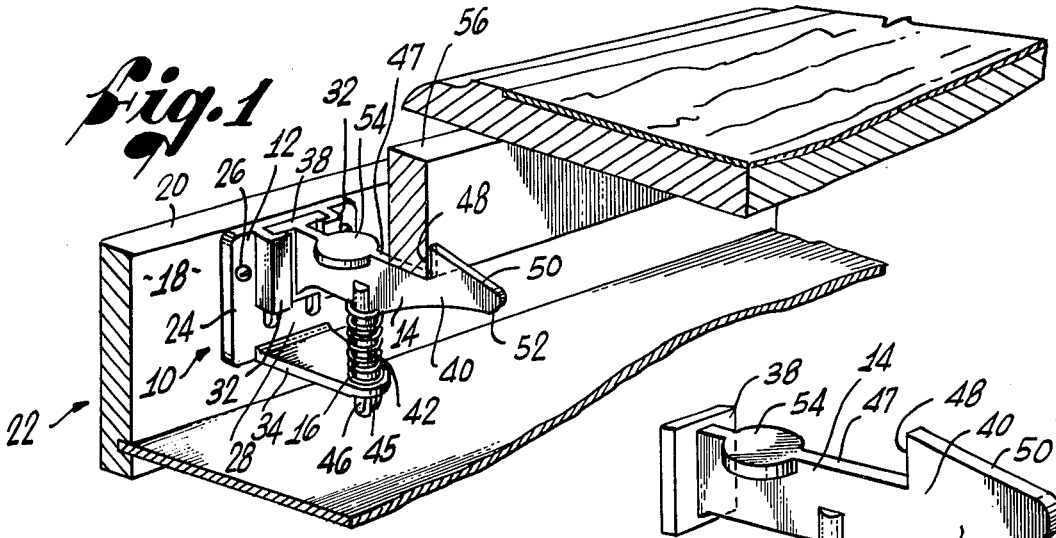
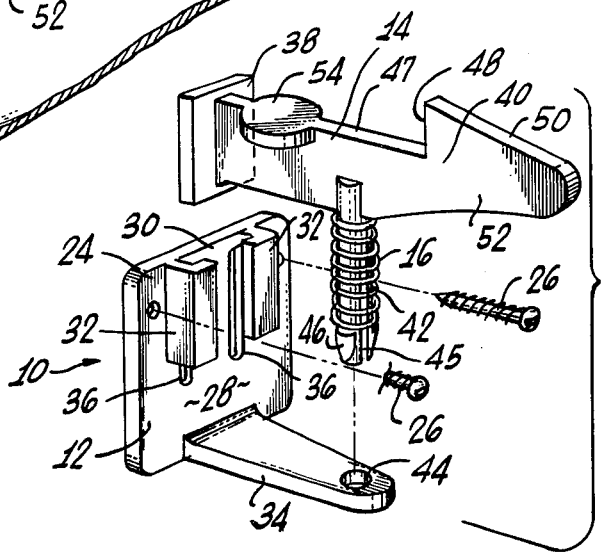
Fig. 3
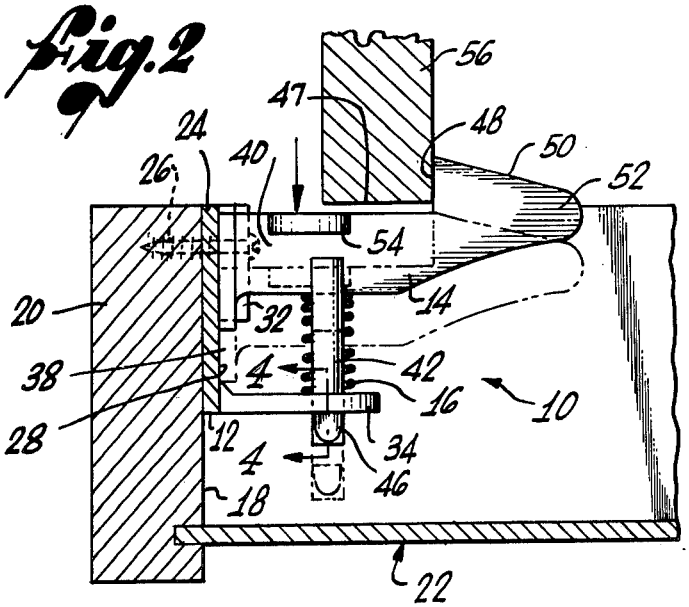
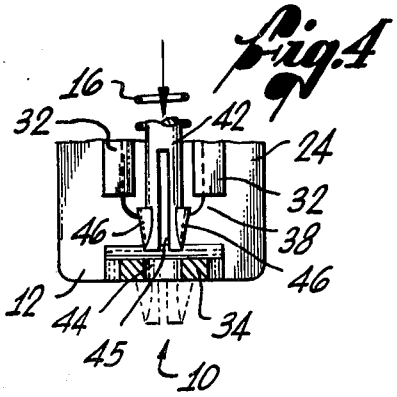

CHILD-PROOF LATCH

BACKGROUND OF THE INVENTION

The present invention relates to latches for cabinets, and more particularly to such latches that are intended to be child-proof.

There are many items generally found in the home that pose an ever present danger to small children unappreciative of their potentially harmful effects. These items include household cleaners, medicines, glue, paint thinners and a great variety of other substances that might be consumed orally. Other such dangerous items are, knives, razor blades, and various tools.

To reduce the danger from these items, it is a common practice to equip the cabinets containing them with "child-proof" latches that are intended to be difficult or impossible for small childern to operate. A latch of this type is conventionally installed on the inside surface of a cabinet closure panel., e.g. a cabinet door or the front panel of a drawer. It allows the closure panel to be opened to a limited extent only, after which it is necessary to reach over the top of the panel and release the latch, usually by depressing a resilient arm to disengage it from an interlocking member mounted on the cabinet frame. Examples of such previously known latches are described in U.S. Pat. Nos. 3,397,001, to Friedman and 3,889,992 to Shelton. In many cases, the closure panel is equipped with a primary latch that secures it in a tightly closed position and the child-proof latch is used as a second or supplemental latch.

It has often been found that previously known latches are not nearly so child-proof as the persons using them might hope. While they may present obstacles to children attempting to gain access to the cabinet's interior, children, like adults, may be able to reach over the top of the closure panel and release the resilient arm. Moreover, it can be very difficult, especially in the case of a shallow drawer, to mount the necessary interlocking member on the cabinet frame.

A principal objective of the present invention is to provide a child-proof latch that overcomes these and other disadvantages previously associated with such devices.

SUMMARY OF THE INVENTION

The present invention resides in a child-proof cabinet latch that accomplishes the above objectives. It includes a base to be mounted on the normally inaccessible inwardly facing surface of a closure panel and a restraining member that is slidable in a guide channel formed on the base. A spring biases the restraining member toward a first position in which an abutment surface on that member is disengaged when the panel is fully closed but is engageable with a portion of the cabinet frame to limit opening movement of the panel. When it is desired to release the latch to permit the panel to be opened fully, the restraining member is moved against the force of the spring to a second position in which it is not engageable with the frame. The spring force is great enough to prevent movement of the restraining member by a small child, but not great enough to prevent such movement by an adult.

Preferably, the restraining member is provided with a finger surface by which it can be conveniently actuated once the closure panel has been opened to the limited extent permitted by the restraining member. A cam surface on the end of the restraining member engages the frame as the closure panel is moved from a fully open to a closed position, causing the restraining member to move temporarily to its second position so that the abutment surface can again be retruned to the inside of the frame. It should be noted that the cabinet frame itself interacts with the abutment surface and it is unnecessary to attach a separate interlocking device to engage the arm.

In a particularly advantageous latch construction, the base includes a mounting plate adapted to overlie the inwardly-facing surface of the closure panel and a spring support member extending perpendicularly to the mounting plate. The restraining member includes a slide plate that is reciprocably movable within the guide channel, an arm that extends away from the slide plate, and a post extending from the arm parallel to the slide plate that is slidably received by an aperture in the spring support. The spring is located between the arm and the spring support and encircles the post.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a perspective view of a latch constructed in accordance with the invention, and mounted in a cabinet (a fragmentary portion of which is illustrated), the latch engaging with the cabinet frame to limit opening movement of a drawer;

FIG. 2 is a cross-sectional view of the latch and fragmentary cabinet portion of FIG. 1, shown in the same position as in FIG. 1 and also shown in phantom lines in a non-engageable position;

FIG. 3 is an exploded view of the latch; and

FIG. 4 is a fragmentary exploded view of a portion of the latch, shown in phantom lines in its assembled position.

DESCRIPTION OF THE PREFERRED EMBODIMENT

An exemplary child-proof latch 10 that embodies many aspects of the present invention, illustrated in the accompanying drawings, includes three basic components: a base 12, a restraining member 14 and a spring 16. As shown in FIGS. 1 and 2, it is positioned on the normally inacessible interior side of a cabinet closure panel, in this case the vertical back side 18 of the exposed front panel 20 of a drawer 22. It will be noted, however, that the latch 10 can also be used with other types of closure panels such as doors that are hinged along one edge.

The base 12 has a vertical mounting plate 24 overlying the interior surface 18 to which it is attached by two wood screws 26. Its top edge is flush with the top of the drawer 22. On the vertical surface 28 of the mounting plate 24, facing away from the interior surface 26, is a vertical guide channel 30 formed by two opposing flanges 32 of L-shaped cross-section, best shown in FIG. 3. At the bottom of the mounting plate 24, perpendicular to it, is a horizontal spring support 34 that extends towards the interior of the drawer 22. The entire base 12 is of one piece, integrally formed molded plastic construction and has two vertical slots 36 in the mounting plate 24, behind the channel flanges 32, to facilitate the molding process.

The restraining member 14 includes a rectangular slide plate 38 that fits within the guide channel 30 where it can reciprocate vertically. A horizontal arm 40 extends from the center of the slide plate 38 into the interior of the drawer 22 and a vertical post 42 projects downwardly from the arm 40 to be slidably received by an aperture 44 in the spring support 34. The post 42 and the spring 36 are spaced from the channel 30 sufficiently to stabilize the restraining member 14 for non-pivotal sliding movement. An axial vertical slot 45 at the bottom end of the post 42 renders that post end radially compressible so that two tapered lugs 46 on opposite sides of the slot can be snapped through the aperture 44 to assemble the latch 10, as indicated in broken lines in FIG. 4.

The top surface 47 of the arm 40 extends horizontally from the slide plate 38 to an upwardly projecting vertical abutment surface 48. It then continues from the top of the abutment surface 48 and away from the slide plates 38 at a downward incline. This inclined portion of the top surface 47 forms a cam surface 50 which functions in a manner explained below, and partially defines a tapered portion 52 at the free end of the arm 40. A dish-shaped finger plate 54 forms part of the horizontal top surface between the slide plate 38 and the abutment surface 48. Like the base 12, the restraining member 14 is integrally formed of molded plastic and the arm 40 has a large enough vertical dimension to make it, along with the rest of the restraining member, substantially rigid.

The coil spring 16 encircles the post 42 between the spring support 34 and the arm 40, resiliently biasing the restraining member 14 toward a first position at the top of the guide channel 30, as illustrated in FIGS. 1 and 2. By compressing the spring 16, the restraining member 14 can be moved to a second position at the bottom of the channel 30, as shown in phantom lines in FIG. 2.

When the drawer 22 is in its fully closed position, the abutment surface 48 is spaced inwardly from and not engaged with a horizontal cabinet frame portion 56 that extends just above the drawer. Accordingly, the drawer 22 can be pulled out, i.e., the closure panel 20 opened, to a limited extent, as shown in FIGS. 1 and 2, before the abutment surface 48 engages the frame 56 and prevents further movement, the restraining member 14 now being in its first or upper portion. Before unlimited opening movement is permitted, the restraining member 14 must be moved downwardly to its second position by pressing on the upper finger surface of the plate 54 exposed between the closure panel 20 and the frame 56, with the tip of one's finger. This vertical displacement of the restraining member 14 upon compression of the spring 16, permits the abutment surface 48 to pass under the frame 56 without engagement.

When the drawer 22 is to be closed again, the closure panel 20 is simply pushed toward the frame 56 in the normal manner, causing the inclined cam surface 50 to engage the lower edge of the frame 56. As the drawer 22 continues to move inwardly, the restraining member 14 is again pushed downwardly from its first to its second position until the abutment surface 48 has passed under the frame 56.

A small child may be discouraged from attempting to operate the latch 10 because it is largely hidden from view, even when the drawer 22 is partially open. The invention does not, however, depend upon this feature alone to make the latch 10 child-proof. The resilient force of the spring 56 is such that it cannot be compressed by a small child pressing on the finger plate 44, but an adult can operate the latch 10 without difficulty. A spring force of the desired magnitude is readily achieved by proper selection of the spring 56, which need not conform to any other parameters and performs no other function.

The relatively large abutment surface 48, permitted by the vertical travel of the restraining member 14, can securely engage the cabinet frame 22 itself and eliminates the need for the installation of a separate interlocking member to mate with the arm 40. Installation of the latch 10 is, therefore, easily accomplished since only one piece, the mounting plate 24, need be attached, and it is mounted on the openable closure panel 20 rather than on the frame 56 which may be difficult to reach with a drill or other tools.

While a particular form of the invention has been illustrated and described, it will also be apparent that various modifications can be made without departing from the spirit and scope of the invention.

I claim:

1. A child-proof cabinet latch comprising:

a base adapted to be mounted on the inwardly facing surface of an openable cabinet closure panel where it is inaccessible when said closure member is in a fully closed position, said base defining a guide channel;

a restraining member with an abutment surface thereon having a first position in which said abutment surface is disengaged when said closure member is fully closed but is engageable with a portion of said cabinet to limit opening movement of said closure panel and a second position in which said abutment surface is not engageable with said portion and permits unlimited opening movement of said closure panel, said restraining member having a slide portion reciprocably confined within said guide channel as said restraining member moves between said first and second positions and an arm that extends away from said slide portion, said arm having a cam surface means thereon for moving said restraining member from said first position to said second position upon movement of said closure panel from an open position to a closed position; and spring means disposed between said base and said restraining member for resiliently biasing said restraining member toward said first position and for urging said restraining member away from a portion of said base, the force of said spring being great enough to prevent movement of said restraining member by a small child but small enough to permit movement of said restraining member by an adult.

2. The latch of claim 1 wherein said restraining members includes a finger plate by which a force can be applied to move said restraining member from said first position to said second position.

3. The latch of claim 1 wherein:

said base includes a mounting plate adapted to overlie said inwardly facing surface and a spring support member extending substantially perpendicular to said mounting plate and having an aperture therein;

said restraining member including a post slidably received within said aperture; and said spring means encircling said post.

4. The latch of claim 3 wherein said post includes a bifurcated and radially compressible end which projects through said aperture and a plurality of retaining lugs formed on said end to prevent withdrawal of said post from said aperture without radial compression thereof.

5. The latch of claim 1 wherein said base and said restraining member are substantially rigid.

6. The latch of claim 5 wherein said base and said restraining member are each integrally formed of molded plastic.

7. In a cabinet having a frame and a movable closure panel with an inwardly facing vertical surface that normally covers an opening in said frame, the improvement of a child-proof supplemental latch comprising:

a mounting plate secured to said vertical surface;

a vertical guide channel integrally formed with said mounting plate and facing away from said vertical surface;

a slide plate vertically reciprocable within said guide channel and inaccessible from the exterior of said cabinet when said closure member is in a fully closed position;

a substantially rigid horizontal arm integrally formed with said slide plate and extending away from said side plate, said arm having first and second vertically displaced positions and being movable between said positions upon sliding of said plate within said guide channel, said arm including:

a vertical abutment surface engageable with said frame upon limited opening movement of said closure panel to prevent further opening movement thereof when said arm is in said first position, said abutment surface being non-engageable with said frame when said arm is in said second positions;

an end portion having a cam surface thereon inclined downwardly and away from said abutment surface and engageable with said frame upon movement of said closure panel toward its closed position to cause downward movement of said arm from its first to its second position; and a plate having a finger surface accessible from outside said cabinet upon limited opening movement of said closure by which a force can be applied to said arm to move said arm from said first to said second position, thereby permitting unrestricted movement of said closure; and spring means for resiliently biasing said arm toward said first position, the force of said spring means being great enough to prevent movement of said arm by a small child but small enough to permit movement of said arm by an adult.

* * * * *